US006421861B1

(12) United States Patent
Cheng

(10) Patent No.: US 6,421,861 B1
(45) Date of Patent: Jul. 23, 2002

(54) MULTIPURPOSE TOOL

(76) Inventor: Yin-Ho Cheng, No. 58, Chungshan Rd., Tucheng Industrial Zone, Taipei County (TW)

( * ) Notice: Subject to any disclaimer, the term of this patent is extended or adjusted under 35 U.S.C. 154(b) by 0 days.

(21) Appl. No.: 09/954,264

(22) Filed: Sep. 18, 2001

(51) Int. Cl.[7] ..... B25F 1/00
(52) U.S. Cl. ..... 7/107; 29/566.4
(58) Field of Search ..... 7/107; 29/278, 29/566.4, 751, 758

(56) References Cited

U.S. PATENT DOCUMENTS 4,696,090 A * 9/1987 Gregson et al. ..... 29/566.4
4,920,637 A * 5/1990 Meyerhoefer et al. ..... 29/764
5,175,921 A * 1/1993 Krietzman ..... 29/566.4
5,613,297 A * 3/1997 Dvorak et al. ..... 29/861
5,813,109 A * 9/1998 Ziegler et al. ..... 29/566.4
5,887,333 A * 3/1999 Clark ..... 29/566.4

* cited by examiner

*Primary Examiner*—Joseph J. Hall, III
*Assistant Examiner*—David B. Thomas
(74) *Attorney, Agent, or Firm*—Rosenberg, Klein & Lee

(57) ABSTRACT

A multipurpose tool includes a main shaft axially slidably inside a housing, a wire crimper holder coupled to the main shaft and locked by a spring-supported locking device, a set of wire crimper elements selectively fastened to the wire crimper holder by screw means for crimping electric wires at any of a variety of wire distribution blocks, a wire cutting tool coupled to a front side of the main shaft adapted to cut electric wires by means of a scissors action, and a hook and a lever respectively pivoted to a rear side of the housing.

4 Claims, 6 Drawing Sheets

MULTIPURPOSE TOOL

BACKGROUND OF THE INVENTION

The present invention relates to hand tools and, more particularly, to a multipurpose tool, which uses a sliding main shaft to hold a wire crimper holder so that the user can selectively attach one of a set of wire crimper elements to the wire crimper holder to fit different wire crimping operations.

When crimping electric wires 9 in different wire distribution blocks 6~8, different wire crimping and cutting tools 44;45;432 shall be used (see FIGS. from 9 through 11). Because conventional wire crimping and cutting tools are designed to fit wire distribution blocks 6 of US specifications, wire distribution blocks 7 of European specifications, or wire distribution blocks 8 of specifications other than the US specifications and the European specifications, it is expensive to prepare different wire crimping and cutting tools.

SUMMARY OF THE INVENTION

The present invention has been accomplished under the circumstances in view. It is one object of the present invention to provide a multipurpose tool, which can be selectively attached with one of a set of wire crimping elements to fit different wire distribution blocks of different specifications. It is another object of the present invention to provide a multipurpose tool, which is equipped with different cutting, prying, and hooking tools. To achieve these and other objects of the present invention, the multipurpose tool comprises a main shaft axially slidably inside a housing, a wire crimper holder coupled to the main shaft and locked by a spring-supported locking device, a set of wire crimper elements selectively fastened to the wire crimper holder by screw means for crimping electric wires at any of a variety of wire distribution blocks, a wire cutting tool coupled to a front side of the main shaft adapted to cut electric wires by means of a scissors action, and a hook and a lever respectively pivoted to a rear side of the housing.

BRIEF DESCRIPTION OF THE DRAWINGS

FIG. 6-1 is a sectional view showing one application example of the present invention.

FIG. 7-1 is a sectional view showing another application example of the present invention.

FIG. 8-1 is a sectional view showing still another application example of the present invention.

DETAILED DESCRIPTION OF THE PREFERRED EMBODIMENT

Figure 1:
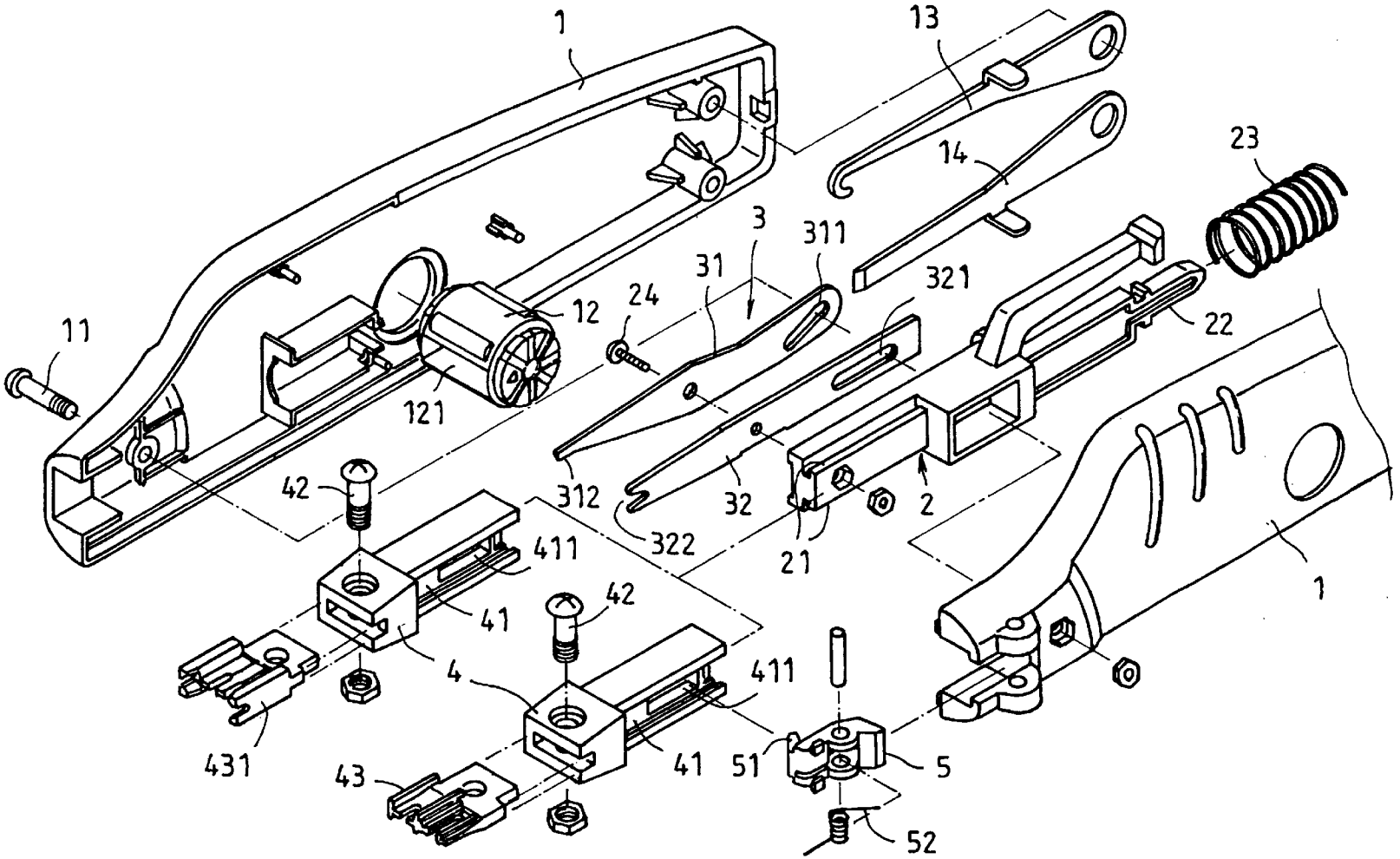
FIG. 1 is an exploded view of a multipurpose tool according to the present invention.
Figure 2:
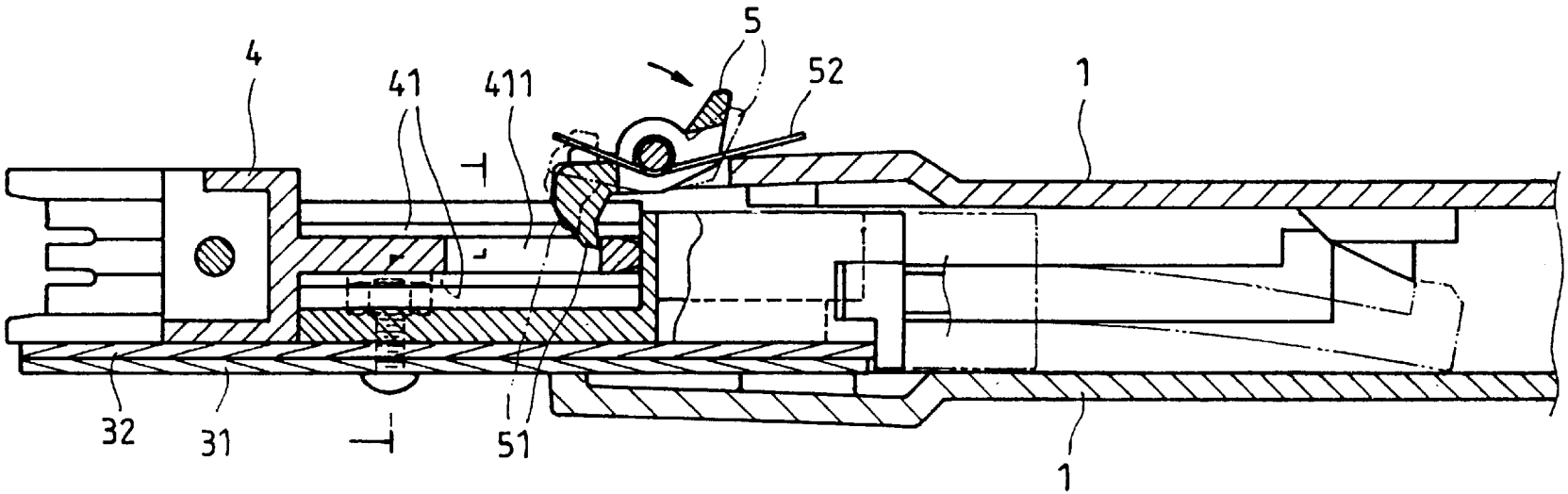
FIG. 2 is a side view in section of a part of the present invention, showing the locking device turned between the locking position and the unlocking position.
Figure 3:
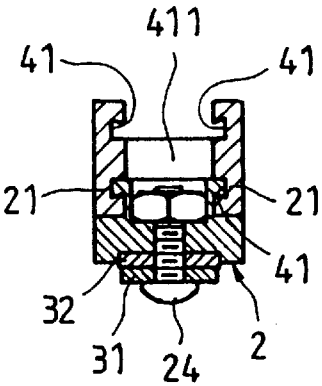
FIG. 3 is a cross sectional view of FIG. 2 showing the connection between the wire crimper holder and the main shaft.

Referring to FIGS. from 1 through 5, a main shaft 2 is axially slidably fastened to the inside of a housing 1 by a screw bolt 11. A spring 23 is mounted inside the housing 1 and fastened to the main shaft 2 to hold the main shaft 2 in a received position. The main shaft 2 has a longitudinally front coupling rail 21, and a longitudinally extended rear positioning rod 22. A wire crimper holder 4 is coupled to the main shaft 2 and adapted to selectively hold one of a set of wire crimper elements 43;431 of different specifications. The wire crimper holder 4 has a longitudinally extended coupling groove 41 coupled to the longitudinally front coupling rail 21 of the main shaft 2, and a retaining hole 411 in the coupling groove 41. The selected wire crimper element 43 or 431 is detachably fastened to the wire crimper holder 4 by a screw bolt 42. A locking device 5 is pivoted to the housing 1 adjacent to the wire crimper holder 4, having a retaining rod 51 adapted to engage the retaining hole 411 of the wire crimper holder 4. A torsional spring 52 is connected between the housing 1 and the locking device 5. The torsional spring 52 imparts a pressure to the locking device 5, forcing the retaining rod 51 of the locking device 5 into engagement with the retaining hole 411 of the wire crimper holder 4. A wire-cutting tool 3 is fastened to the front side of the main shaft 2 by a screw bolt 24. The wire-cutting tool 3 is comprised of two cutting blades, namely, the first cutting blade 31 and the second cutting blade 32 adapted to cut off wires by means of a scissors action. The first cutting blade 31 is turned about the screw bolt 24, having a straight front cutting edge 312, and an oblique rear coupling slot 311 coupled to the screw bolt 11. The second cutting blade 32 is turned about the screw bolt 24, having a V-shaped front cutting notch 322, and a straight rear coupling slot 321 coupled to the screw bolt 11. During operation, the V-shaped front cutting notch 322 of the second cutting blade 32 is attached to the wires to be cut, and then the multipurpose tool is forced downwards, causing the first cutting blade 31 to be turned about the screw bolt 24 relative to the second cutting blade 32, and therefore the straight front cutting edge 312 is moved over the V-shaped front cutting notch 322, to cut off the electric wires. Further, a control wheel 12 is transversely mounted in the housing 1 and adapted to control the position of the main shaft 2. The control wheel 12 has a transverse through hole 121. Normally, the periphery of the control wheel 12 is stopped against the rear positioning rod 22 of the main shaft 2, keeping the main shaft 2 in the extended position. When rotated the control wheel 12 to the angular position where the transverse through hole 121 is in alignment with the rear positioning rod 22, the spring 23 immediately pulls the main shaft 2 backwards from the extended position to the received position, keeping the rear positioning rod 22 inserted into the transverse through hole 121.

Referring to FIGS. from 6 through 8 and FIGS. from 6-1~8-1, the user can selectively fasten the wire crimper elements 43;431 to the wire crimper holder 4 for crimping electric wires 9 in different wire distribution blocks 6~8.

Figure 4:
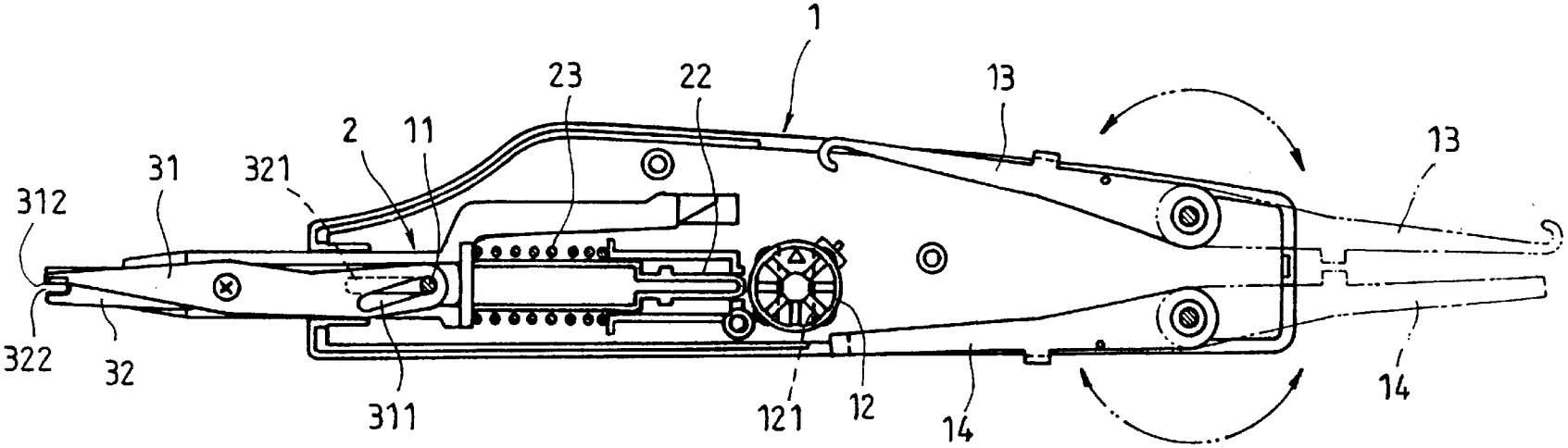
FIG. 4 is a plain view of the present invention, showing the hook and the lever turned in and out of the housing.
Figure 5:
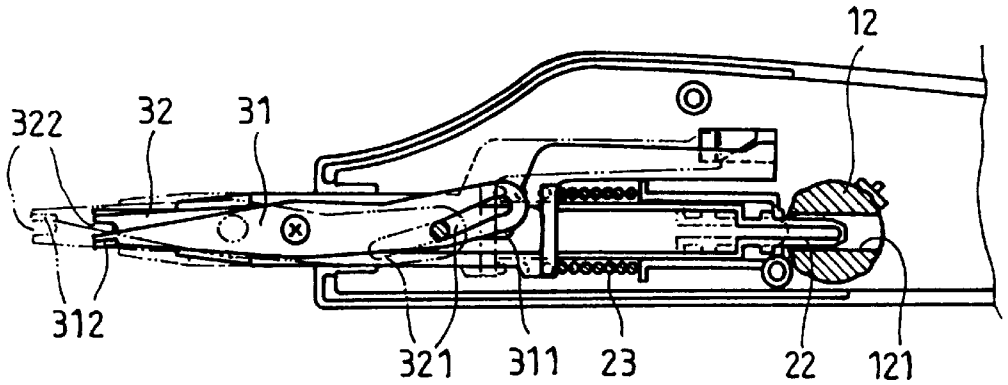
FIG. 5 is a plain view of a part of the present invention, showing the action of the wire-cutting tool.
Figure 8:
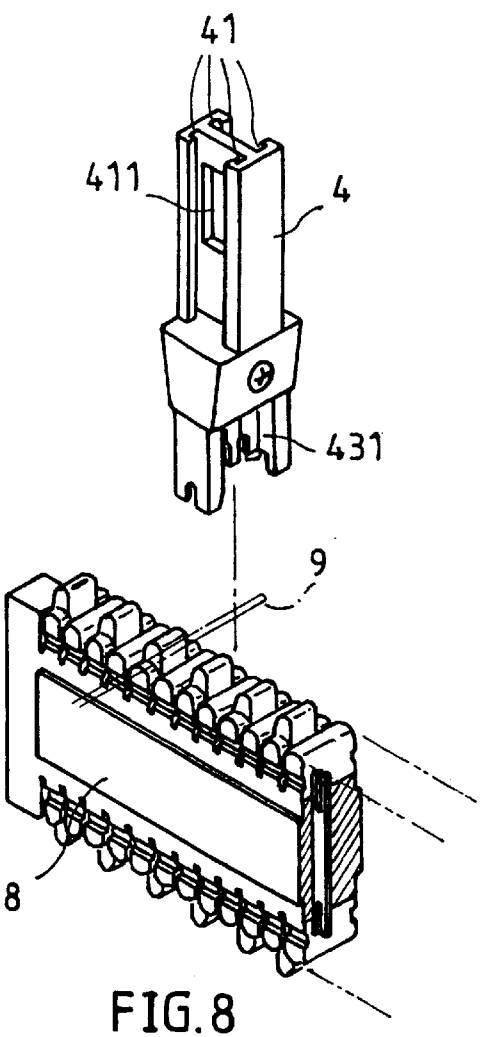
FIG. 8 shows the wire crimper holder attached with a second wire crimper element to match still another wire distribution block.
Figure 7:
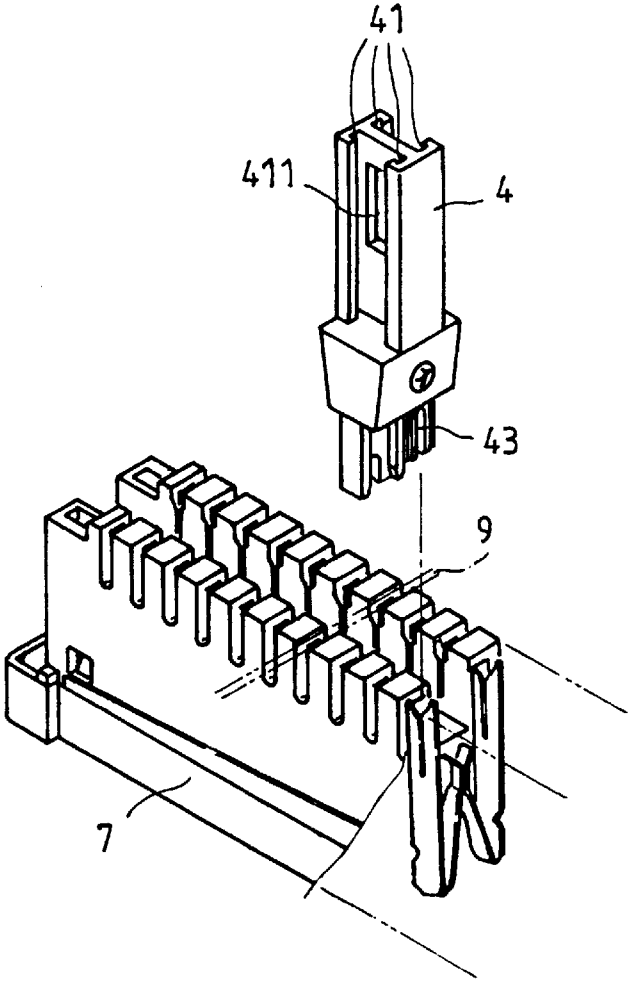
FIG. 7 shows the wire crimper holder attached with a first wire crimper element to match another wire distribution block.
Figure 6:
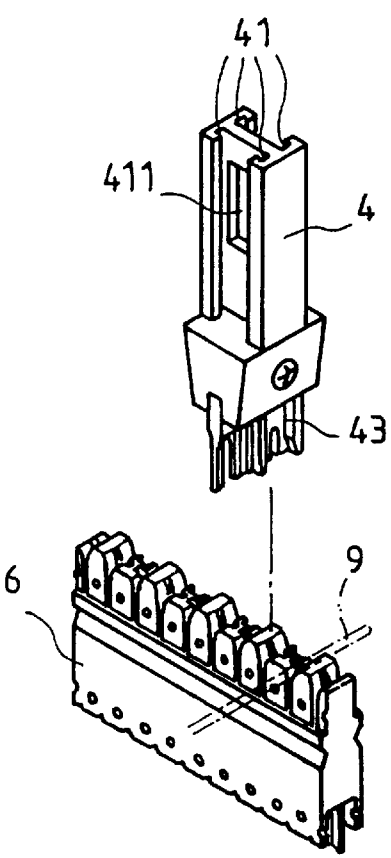
FIG. 6 shows the wire crimper holder attached with a first wire crimper element to match one wire distribution block.
Figures 1, 6, 7, 8:
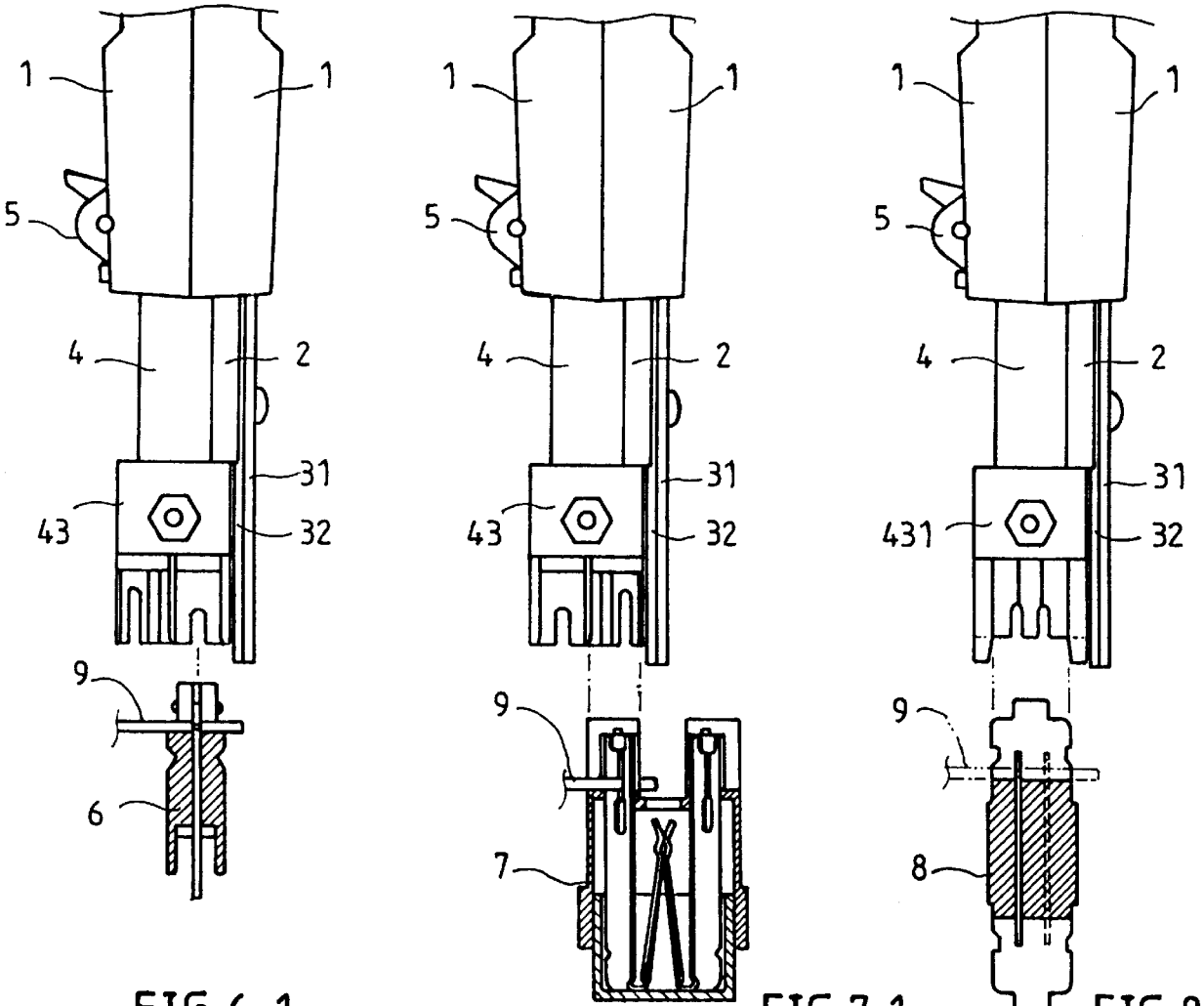
Figure 11:
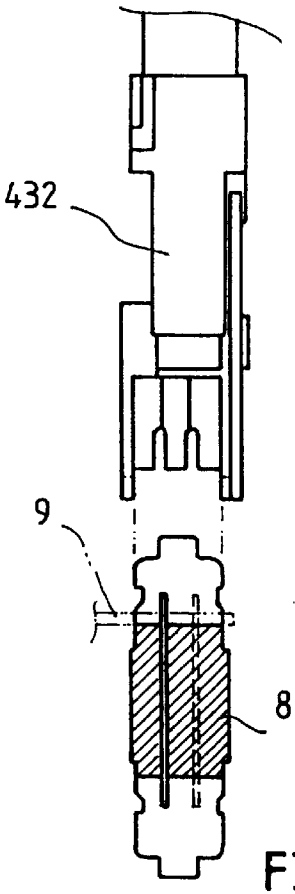
FIG.11 PRIOR ART
FIG. 11 shows still another structure of wire crimping and cutting tool used with still another structure of wire distribution block according to the prior art.
Figure 10:
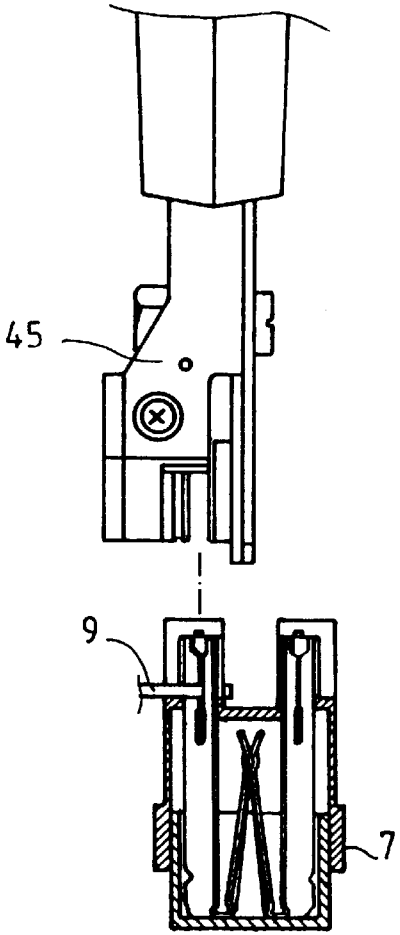
FIG.10 PRIOR ART
FIG. 10 shows another structure of wire crimping and cutting tool used with another structure of wire distribution block according to the prior art.
Figure 9:
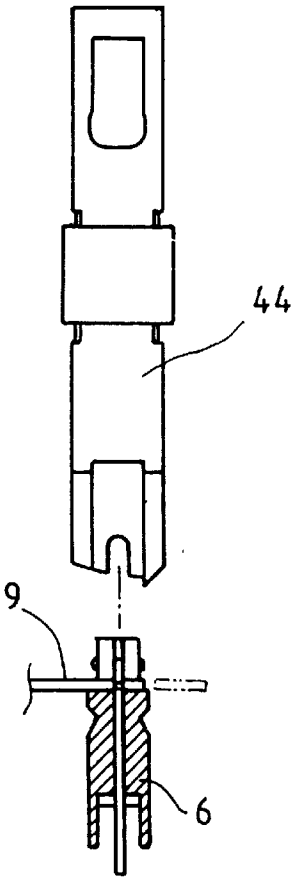
FIG.9 PRIOR ART
FIG. 9 shows a wire crimping and cutting tool used with one wire distribution block according to the prior art.

Referring to FIGS. 1 and 4 again, a hook 13 and a lever 14 are pivotally mounted in the rear side of the housing 1, and can be respectively turned in and out of the housing 1 between the operative position and the non-operative position.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A multipurpose tool comprising a housing, a main shaft axially slidably coupled to said housing by a slip joint and moved axially between an extended position and a received position, said main shaft comprising a longitudinally extended front coupling rail and a rear positioning rod, a wire crimper holder coupled to said main shaft, said wire crimper holder comprising a longitudinal coupling groove coupled to the front coupling rail of said main shaft and a retaining hole, a set of wire crimper elements selectively fastened to said wire crimper holder by screw means, a torsional spring mounted inside said housing, and a locking device pivoted to said housing and forced by said torsional spring to lock said wire crimper holder, said locking device having a retaining rod adapted to engage the retaining hole of said wire crimper holder.

2. The multipurpose tool as claimed in claim 1 further comprising a wire cutting tool adapted to cut electric wires by means of a scissors action, said wire cutting tool comprising a first cutting blade and a second cutting blade respectively turned about a first pivot at a front side of said main shaft, said first cutting blade having a straight front cutting edge and an oblique rear coupling slot, said second cutting blade having a V-shaped front cutting notch and a straight rear coupling slot coupled with the oblique rear coupling slot of said first cutting blade to a second pivot at a middle part of said main shaft.

3. The multipurpose tool as claimed in claim 1 further comprising a control wheel pivoted to said housing and adapted to support said main shaft in said extended position, said control wheel having a transverse through hole through the periphery thereof, and spring means connected between said housing and said main shaft and adapted to pull said main shaft from said extended position to said received position after said control wheel had been rotated to the position where said transverse through hole of said control wheel is in alignment with the rear positioning rod of said main shaft.

4. The multipurpose tool as claimed in claim 1 further comprising a lever and a hook respectively pivoted to a rear side of said housing and turned in and out of said housing between an extended position and a received position.

* * * * *